United States Patent [19]

Wakao et al.

[11] 4,386,841

[45] Jun. 7, 1983

[54] IMAGE-FORMING DEVICE HAVING A PHOTOSENSITIVE MEMBER

[75] Inventors: Nobutaka Wakao, Kawasaki; Reiji Murakami; Katsuhiko Okamoto, both of Yokohama; Kohachi Uchida, Sagamihara, all of Japan

[73] Assignee: Tokyo Shibaura Denki Kabushiki Kaisha, Japan

[21] Appl. No.: 312,162

[22] Filed: Oct. 16, 1981

[30] Foreign Application Priority Data

Oct. 31, 1980 [JP] Japan ..... 55-154402

[51] Int. Cl.[3] ..... G03G 15/00

[52] U.S. Cl. ..... 355/3 DR; 29/123

[58] Field of Search ..... 355/3 DR, 3 R, 8, 11; 29/123

[56] References Cited

U.S. PATENT DOCUMENTS

| | | | |
|---|---|---|---|
| 3,604,797 | 9/1971 | Szczesniak | 355/16 |
| 3,736,053 | 5/1973 | Shreeve et al. | 355/3 DR |
| 3,966,316 | 6/1976 | Pfeifer et al. | 355/3 DR |
| 3,997,262 | 12/1976 | Doi | 355/11 |
| 4,114,998 | 9/1978 | Shimizu | 355/3 DR |
| 4,334,761 | 6/1982 | Saito et al. | 355/3 R |

FOREIGN PATENT DOCUMENTS

| | | | |
|---|---|---|---|
| 3004142 | 8/1980 | Fed. Rep. of Germany | 355/3 DR |

*Primary Examiner*—Richard L. Moses

*Attorney, Agent, or Firm*—Schuyler, Banner, Birch, McKie & Beckett

[57] ABSTRACT

A clam-shell type image-forming device such as photocopying or facsimile machine has an upper unit and a lower unit hinged to each other at one side. Access to internal parts, such as the photosensitive member, is gained by unlocking the two units from each other and rotating the upper unit upward. A subframe is included within the upper unit and contains the photosensitive member. When the upper unit is opened, the subframe may be lowered to position the photosensitive member for easy inspection and removal.

8 Claims, 12 Drawing Figures

10A
10B
30A
30a
70
70b
70d
72
78
20
18
22
19
19'
19'A
19'B
19'C
19'D
19'E
19'F
19'G
39'
39'A
36'
18a
Y
Z
71
74
10
12
13
14
15
16
17
24
26
33
P

IMAGE-FORMING DEVICE HAVING A PHOTOSENSITIVE MEMBER

BACKGROUND OF THE INVENTION

This invention relates to devices, such as photocopying or facsimile machines, which reproduce graphic images by transferring them to a photosensitive member and then to a sheet of copying paper. Typically, such image-forming devices have a casing divided into an upper unit and a lower unit which are hinged to each other at one side, and the photosensitive member is located in the upper unit. In operation, the two units are locked together.

If copying paper should become jammed somewhere in the transportation path within the machine, the two units can be unlocked from each other and the upper one rotated upward to some convenient angle, for example 25°, so the operator can locate and remove the jammed copying paper. At the same time, he may remove any copying paper which has failed to separate from the photosensitive member, or he may inspect it for surface damage. One problem with this arrangement is that access to the photosensitive member is inconvenient because of its location in the bottom of the inclined upper unit.

Even more serious difficulties are attendant upon removal and replacement of the photosensitive member. Since it is surrounded, in the upper unit, by such items as the charging unit, developing unit, and cleaning unit, several of these must also be removed at the same time; and when the machine is reassembled, they must be adjusted. Furthermore, there always exists the danger that the photosensitive member will be damaged by falling onto the machine's lower unit when it is released from the upper unit.

SUMMARY OF THE INVENTION

This invention overcomes the prior art disadvantages mentioned above. The invention is an image-forming device having a photosensitive member whereby the photosensitive member is positioned to be inspected easily by an operator when the upper unit is raised from the lower unit.

Another object of the invention is to provide such an image-forming device in which the photosensitive member is not easily damaged during removal or replacement.

This invention is directed to a clam-shell type image-forming device in which the upper unit is pivotally mounted to one end of the lower unit. The upper unit includes a cylindrical photosensitive member and a pivoting subframe for receiving the photosensitive member. Upon raising the upper unit (after moving the photosensitive member from the upper unit to the subframe), the operator may lower the subframe. The photosensitive member is therefore positioned between the upper and lower units and can be removed from the subframe at a right angle to its shaft direction.

According to the present invention, the operator can easily check, mount and remove the cylindrical photosensitive member. Another advantage of the present invention is that it is no longer necessary, when removing or replacing the photosensitive member, also to remove the developing unit and the cleaning unit. Therefore, there is no danger of inadvertently shifting them; and a stable image can be maintained.

Furthermore, since the structure of the image-forming device is very simple due to this invention, highly reliable products can be supplied at a low cost.

Other objects and features of the present invention will be apparent from the following description read in connection with the accompanying drawings.

BRIEF DESCRIPTION OF THE DRAWINGS

FIG. 6(*b*) is a sectional view as in FIG. 6(*a*), but showing the docking shaft removed and the photosensitive member resting on the subframe (before it is lowered from the upper unit).

FIG. 7(*b*) is a side view of the docking shaft of FIG. 7(*a*).

FIG. 7(*c*) is a side view of the gear, shown in FIG. 7(*a*), which rotates the photosensitive member when it is in its normal operating position.

In FIG. 8(*a*) the machine is closed, and in FIG. 8(*b*) it is open.

DETAILED DESCRIPTION OF THE PREFERRED EMBODIMENT

While reference is made in the present application to a copying machine, it should be clear that the present invention can be employed with other image-forming devices such as facsimile machines.

Figure 1:
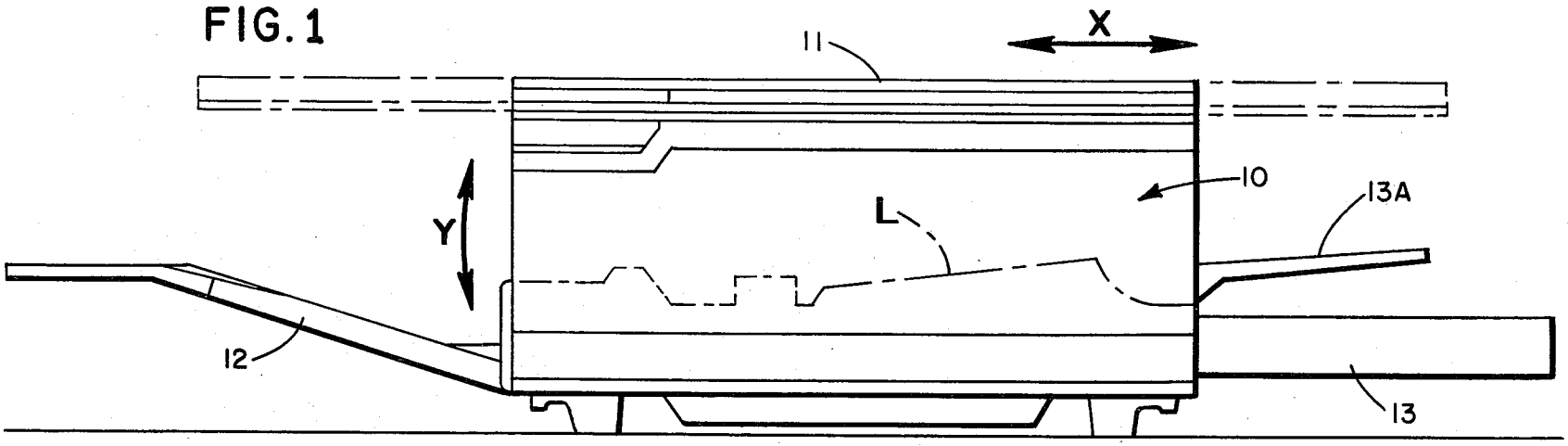
FIG. 1 is a front view of a copying machine of the type described in this invention.

As shown in FIG. 1, the original of the document to be copied is carried in an original carrier 11 which is reciprocated in the X direction by a drive mechanism (not shown). A more detailed discussion of the remaining parts of copying machine 10 shown in FIG. 1 will be made with reference to FIG. 2.

A copy receiving tray 12 is removably mounted on the left side of copying machine 10. A cassette 13 for storing copying papers P and a manual feed guide member 13A for manually feeding papers are provided on the right side. A paper supplying mechanism 14 is coupled to cassette 13 and guide member 13A for feeding papers stored in the cassette 13 and feed guide member 13A.

A transfer mechanism 15 transfers the developer (i.e., toner) from photosensitive member 18 to copying paper P. Transportation mechanism 16 transports the transferred copying paper P to a fusing mechanism 17 for fusing transferred toner onto the paper.

Photosensitive member 18 comprises a selenium drum which is rotatably mounted. Spaced around photosensitive member 18 are the following units: a developing unit 19 for storing toner; a cleaning device 20 for cleaning the residual toner from photosensitive member 18; an illuminating system 21 for illuminating the original carried by original carrier 11; a lens system 22 for focusing light reflected from the original onto photosensitive member 18; and a charger 23 for uniformly producing an electrostatic charge on the photosensitive member 18. Further, several additional elements are spaced around photosensitive member 18: a paper separator 26 which performs corona discharge to separate the copying paper P, a discharger 27 for removing the charge from photosensitive member 18 after it has transferred the image to copying paper P, and an exposure lamp 28 for uniformly illuminating photosensitive member 18 before charging. In addition, there are provided a transportation roller 24 for transporting the fused copying paper P to tray 12 and a motor 25 for reciprocally moving original carrier 11 and for rotating photosensitive member 18. Also shown in a cooling fan 29 for cooling the fusing mechanism 17. Paper detector S is provided against tray 12 for detecting the normal exiting of fused copying paper to tray 12 and producing an error signal when copying paper does not exit at the proper time.

Figure 2:
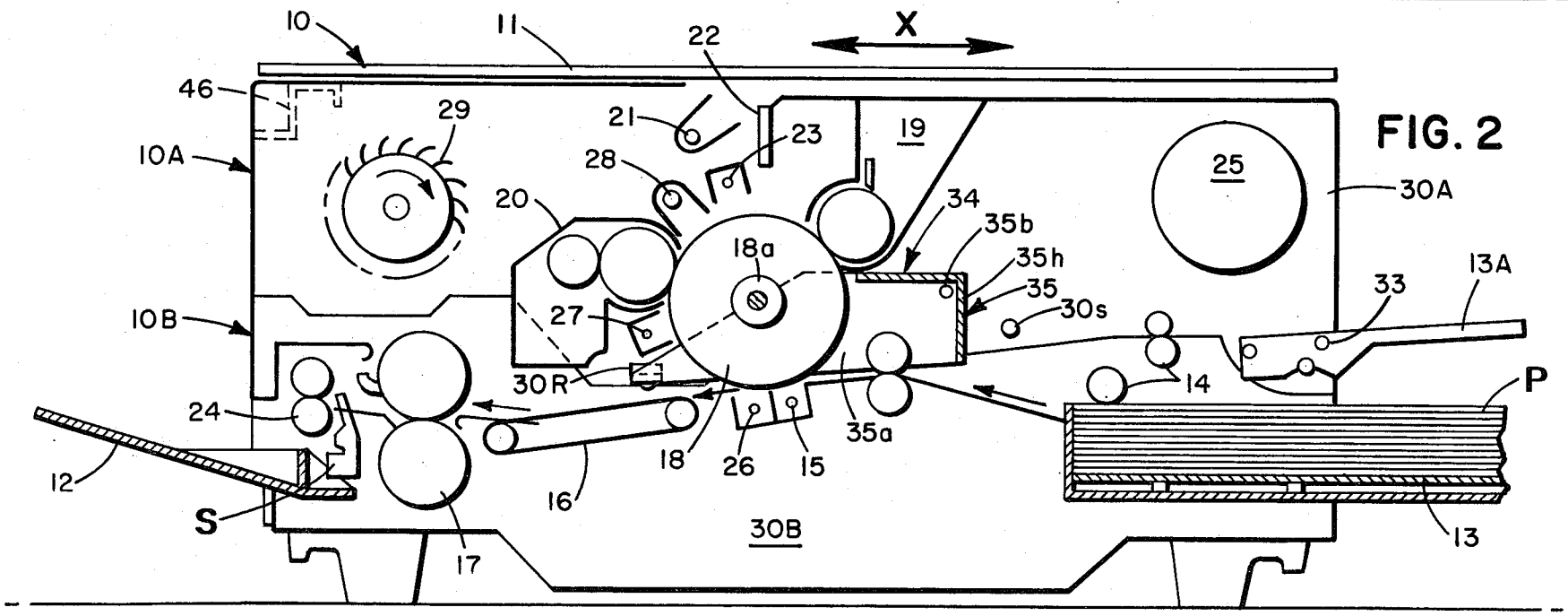
FIG. 2 is a sectional view, of the copying machine shown in FIG. 1, taken along line II—II of that figure.
Figure 3:
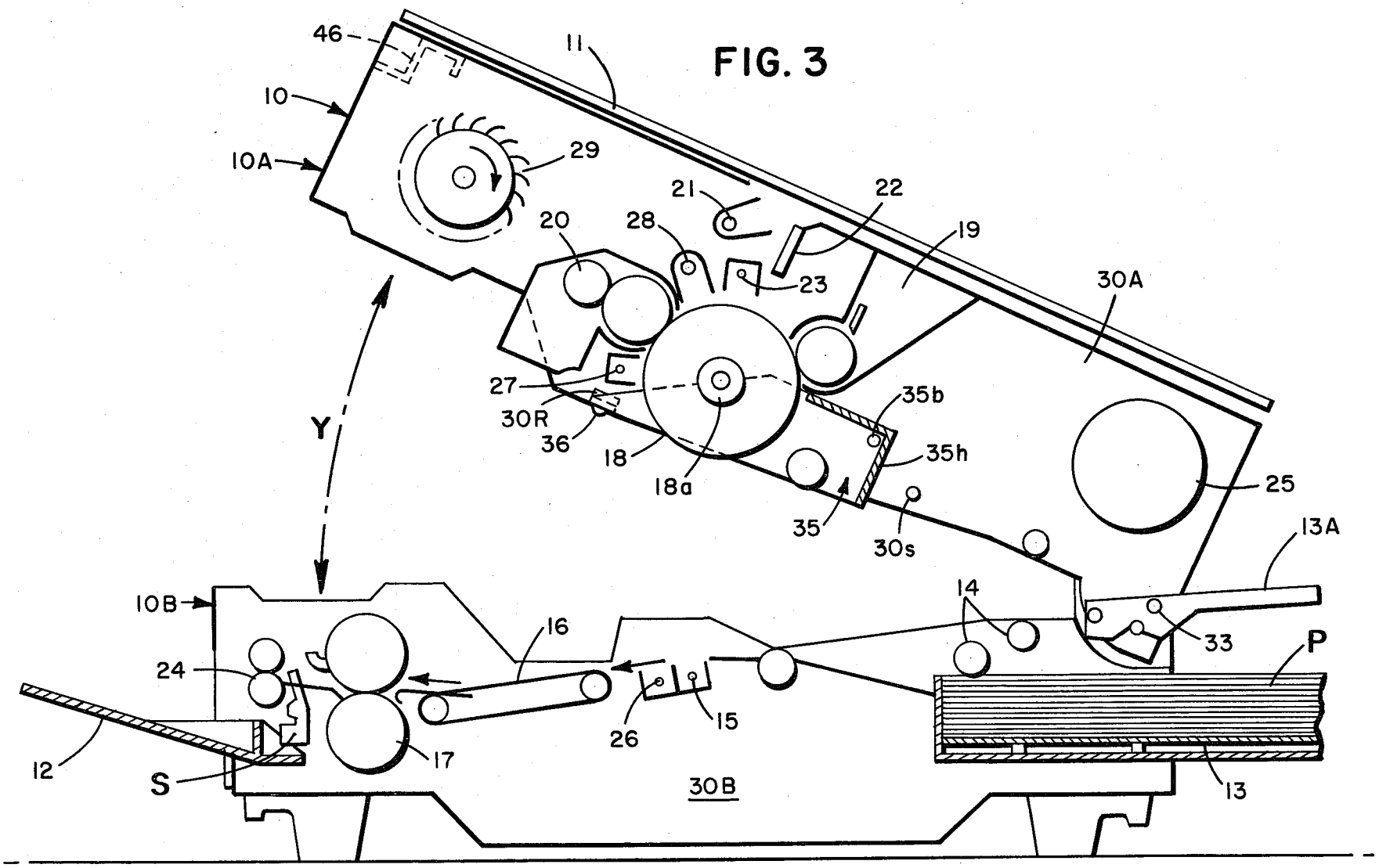
FIG. 3 is a sectional view as in FIG. 2, but with the machine opened.
Figure 4:
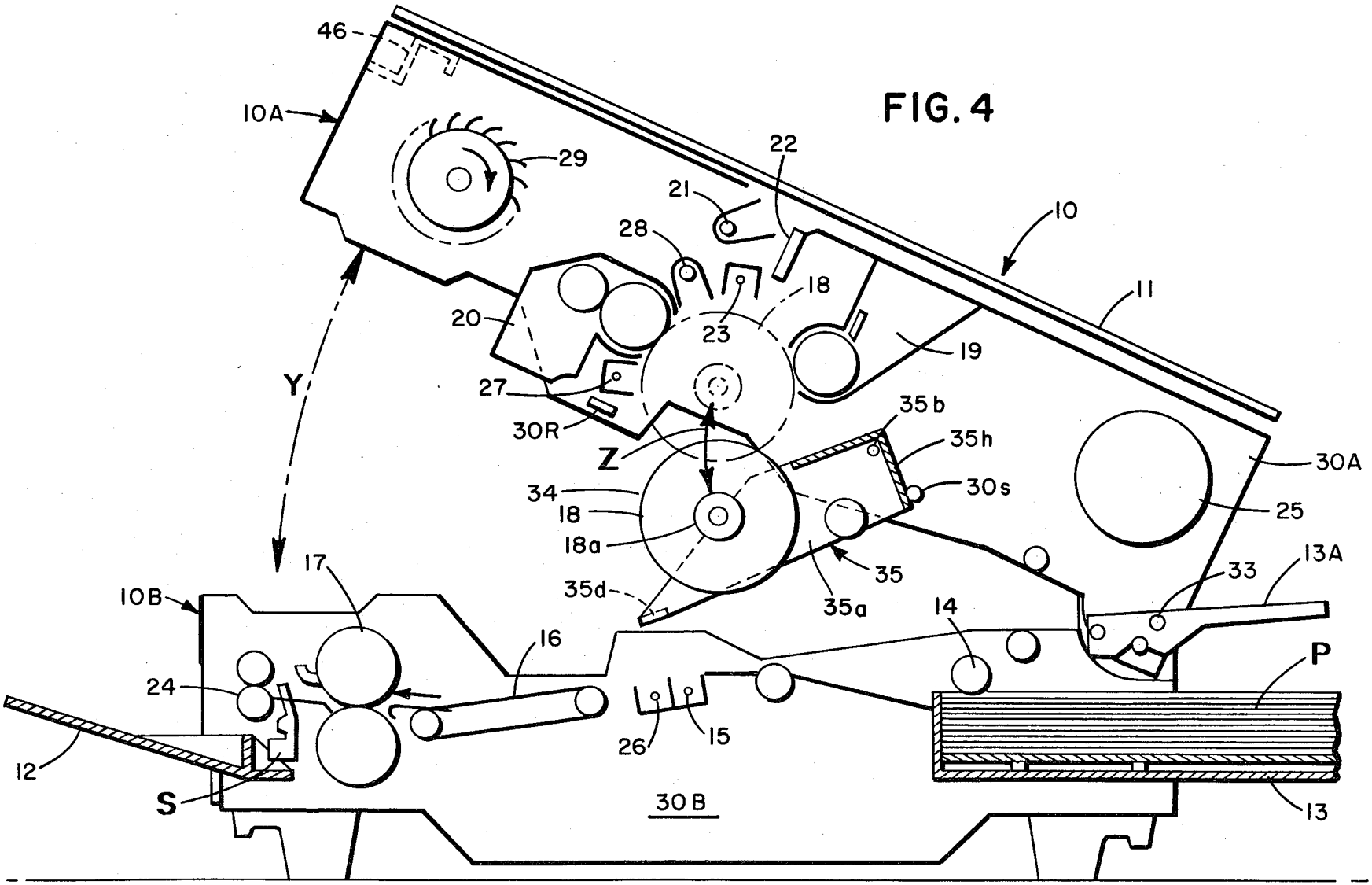
FIG. 4 is a sectional view of the opened copying machine as in FIG. 3, but also showing the subframe, which supports the photosensitive member during inspection, lowered from the upper unit.

As shown in FIGS. 2, 3 and 4, the copying machine is constructed of two units, an upper unit 10A and a lower unit 10B. The upper unit 10A has an upper frame 30A while the lower unit 10B has a lower frame 30B. By rotating an unlocking handle 46, these units can be unlocked. The upper unit can be raised to a desired angle (e.g., 25°) in the direction of arrow Y, pivoting about a hinge point. The upper and lower units are separated along line L (see FIG. 1). Therefore, paper P can easily be removed if it becomes jammed along the transportation path.

Figure 5:
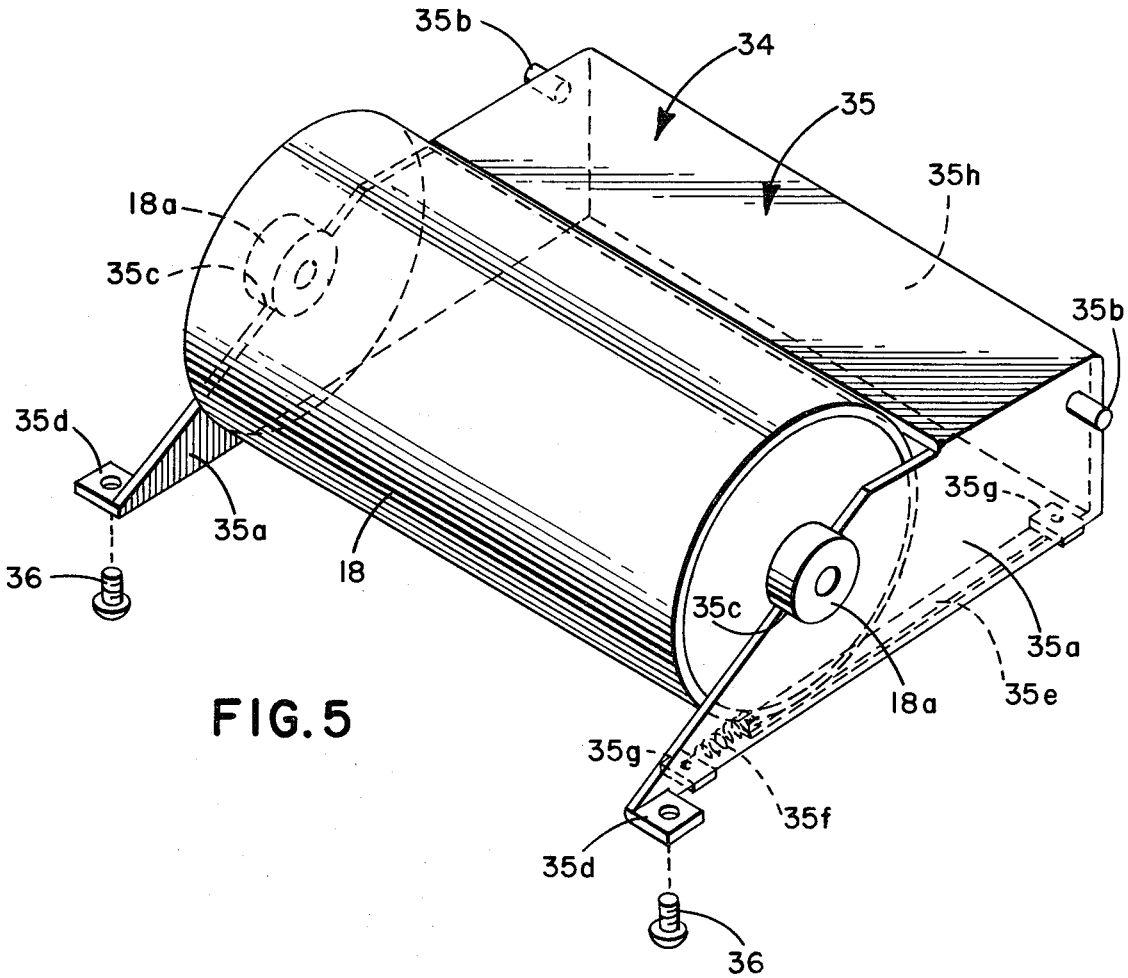
FIG. 5 is a perspective view of the subframe supporting the photosensitive member.

FIGS. 4 and 5 show in detail the construction of the photosensitive member supporting device 34. The photosensitive member supporting device 34 has a subframe 35 having a U-shaped section bent on both ends to form a pair of side walls 35*a*. On the surface of the side walls 35*a* are hinge pins 35*b* aligned with each other so as to allow subframe 35 to rotate within upper frame 30A. At the upper edge of each side wall 35*a* of subframe 35 is located a pair of receiving notches 35*c* for receiving the shaft 18*a* of photosensitive member 18. At the end of each side wall 35*a* is formed a bracket 35*d* for attaching the side wall 35*a* to upper frame 30A. Brackets 35*d* are constructed to attach to plates 30R on upper frame 30A using fasteners 36 (e.g., screw, nylon latch, etc.).

Photosensitive member 18 in normal operation is held in place in upper frame 30A by docking shaft 39 (described later) inserted through shaft 18*a*. When photosensitive member 18 is supported by docking shaft 39 in upper frame 30A, it is separated slightly from receiving notch 35*c*.

Inside of one side wall 35*a*, a copying paper separating element 35*e*, for separating copying paper P from photosensitive member 18, is stretched by spring 35*f* between keepers 35*g*.

Figure 6A:
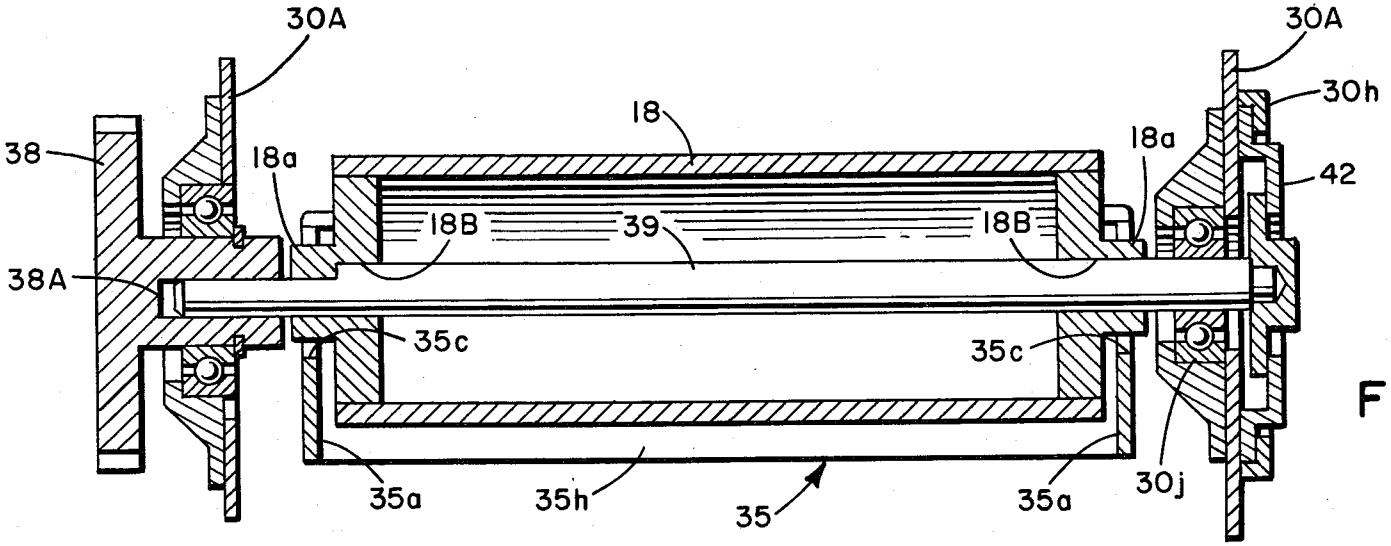
FIG. 6(*a*) is a sectional view showing the photosensitive member held in its normal operating position within the upper unit of the machine by the docking shaft.
Figure 6B:
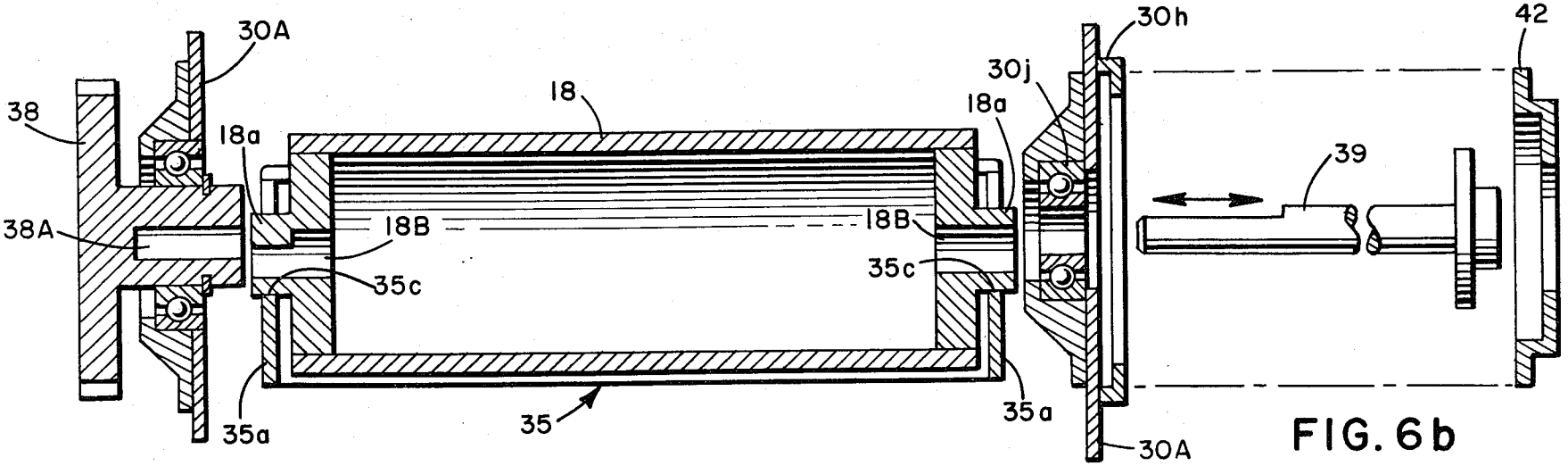

FIGS. 6(*a*) and 6(*b*) show construction details of the means by which photosensitive member 18 is mounted in, and released from, upper frame 30A. When photosensitive member 18 is in its normal operating position, mounted in upper frame 30A, the condition of subframe 35 of photosensitive member supporting device 34 is as shown in FIG. 6(*a*). Photosensitive member 18 is attached by its release means, docking shaft 39, to upper frame 30A and can be rotated by the force received from driving means, gear 38. In such a condition, shaft 18*a* of photosensitive member 18 is separated from, and above, notch 35*c* of subframe 35.

When photosensitive member 18 is disengaged from its driving means, the condition of subframe 35 of photosensitive member supporting device 34 is as shown in FIG. 6(*b*). After locking ring 42 is removed from retainer 30*h* by rotating it, docking shaft 39 can be drawn out from the right through holes 18B of photosensitive member 18. When the docking shaft is removed, the photosensitive member is disconnected from upper frame 30A and drops by its own weight so that its shaft 18*a* rests in receiving notches 35*c*.

When photosensitive member 18 is resting on subframe 35, the operator removes fasteners 36 which attach brackets 35*d* to plates 30R of upper frame 30A. This allows subframe 35 to rotate downward (counterclockwise along direction Z as shown in FIG. 4), pivoting about hinge pins 35*b*, by its own weight. After subframe 35 rotates through a predetermined angle, back frame 35*h* of subframe 35 contacts a stopper pin 30*s* on upper frame 30A. At that point, rotation stops, and photosensitive member 18 is midway between upper unit 10A and lower unit 10B. Subframe 35 (supporting photosensitive member 18) is open counterclockwise from upper unit 10A while upper unit 10A is opened clockwise from lower unit 10B. Therefore, photosensitive member 18 can be inspected or removed as necessary.

When replacing photosensitive member 18 in copying machine 10, shaft 18*a* is first coupled with receiving notches 35*c* of subframe 35 which is opened with respect to upper frame 30A. Next, subframe 35 is rotated clockwise to close into upper unit 10A as shown in FIG. 4. Brackets 35*d* of subframe 35 are then attached to plates 30R of upper frame 30A by fasteners 36.

As shown to FIG. 6(*b*), docking shaft 39 is inserted to the left through a bearing 30*j* of upper frame 30A. As the diameter of the left end of docking shaft 39 is smaller than that of the rest, docking shaft 39 can go through holes 18B of photosensitive member 18 while it rests in receiving notches 35*c*. Upon further insertion, the end of docking shaft 39 couples to holes 38A of gear 38. As a result, shaft 18*a* of photosensitive member 18 rises slightly above receiving notches 35*c*. Finally, docking shaft 39 is secured in place by rotating locking ring 42 into retainer 30*h* shown in FIG. 6(*a*). Photosensitive member 18 will then be rotated by gear 38 connected with a proper driving device and its transmission member (not shown). In a copying machine constructed as described above, photosensitive member 18 alone can be removed from upper unit 10A without also removing each device arranged around it.

Figure 7C:
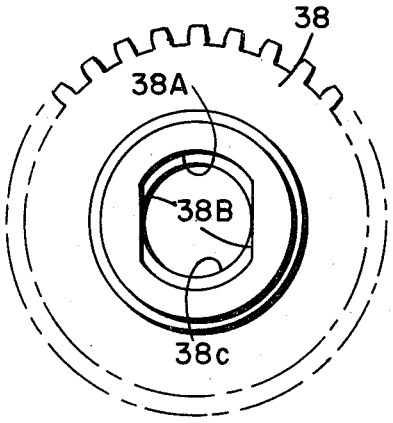
FIG. 7(*a*) is an enlarged sectional view of the photosensitive member held in its normal operating position, similar to FIG. 6(*a*), but showing a different type of docking shaft in another embodiment of this invention.
Figure 7B:
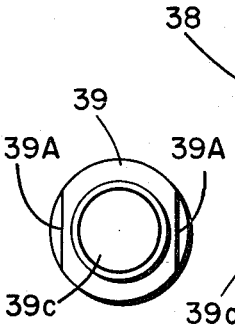
Figure 7A:
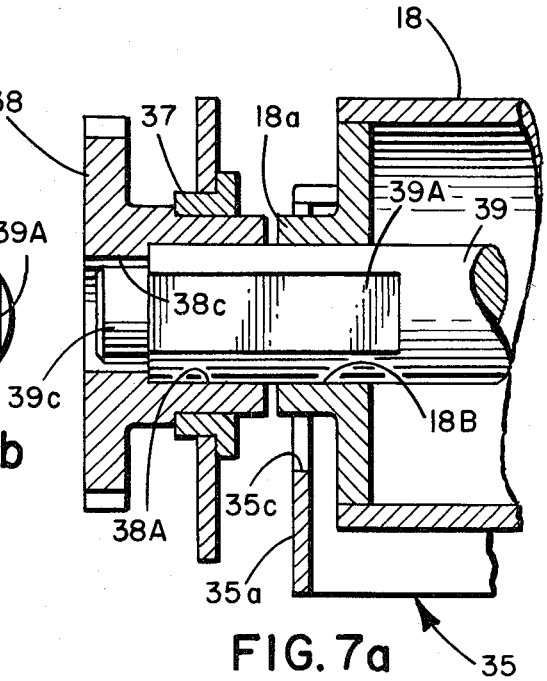

FIGS. 7(*a*), (*b*), and (*c*) show cross-sectional views of the driving and release means of another embodiment of this invention.

In this embodiment, gear 38 is rotatably mounted in upper frame 30A by a bearing 37, and flats 38B are formed on opposite sides within a coupling hole 38A of gear 38. Within hole 18B of photosensitive member 18, corresponding flats are formed. The left end of docking shaft 39 is shaped to mate with these flats by forming similar flats 39A on the sides of the shaft. The gear 38 is rotated by a suitable device (not shown). Rotational motion will be transferred from the gear to the photosensitive member 18 when the docking shaft is inserted so that the flat portions 39A of its surface are in contact both with the flat sections in hole 18B of the photosensitive member and with the flat sections in hole 38A of the gear.

Figure 8A:
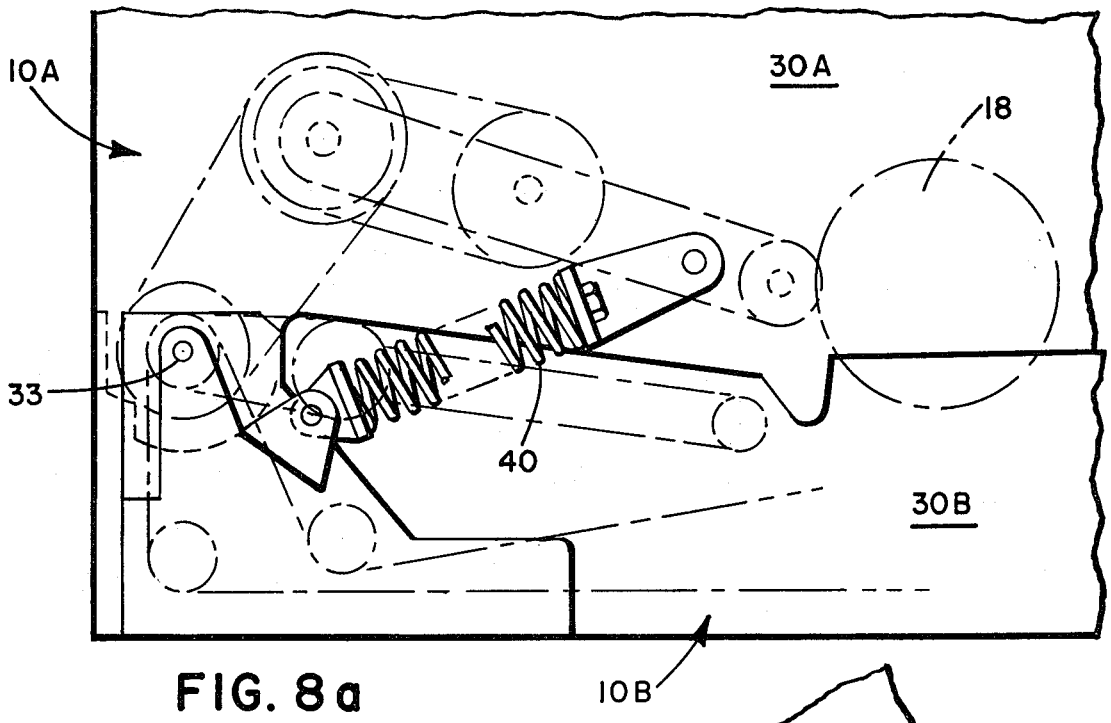
FIG. 8 is a schematic diagram showing the mechanism which supports upper unit when the copying machine is open.
Figure 8B:
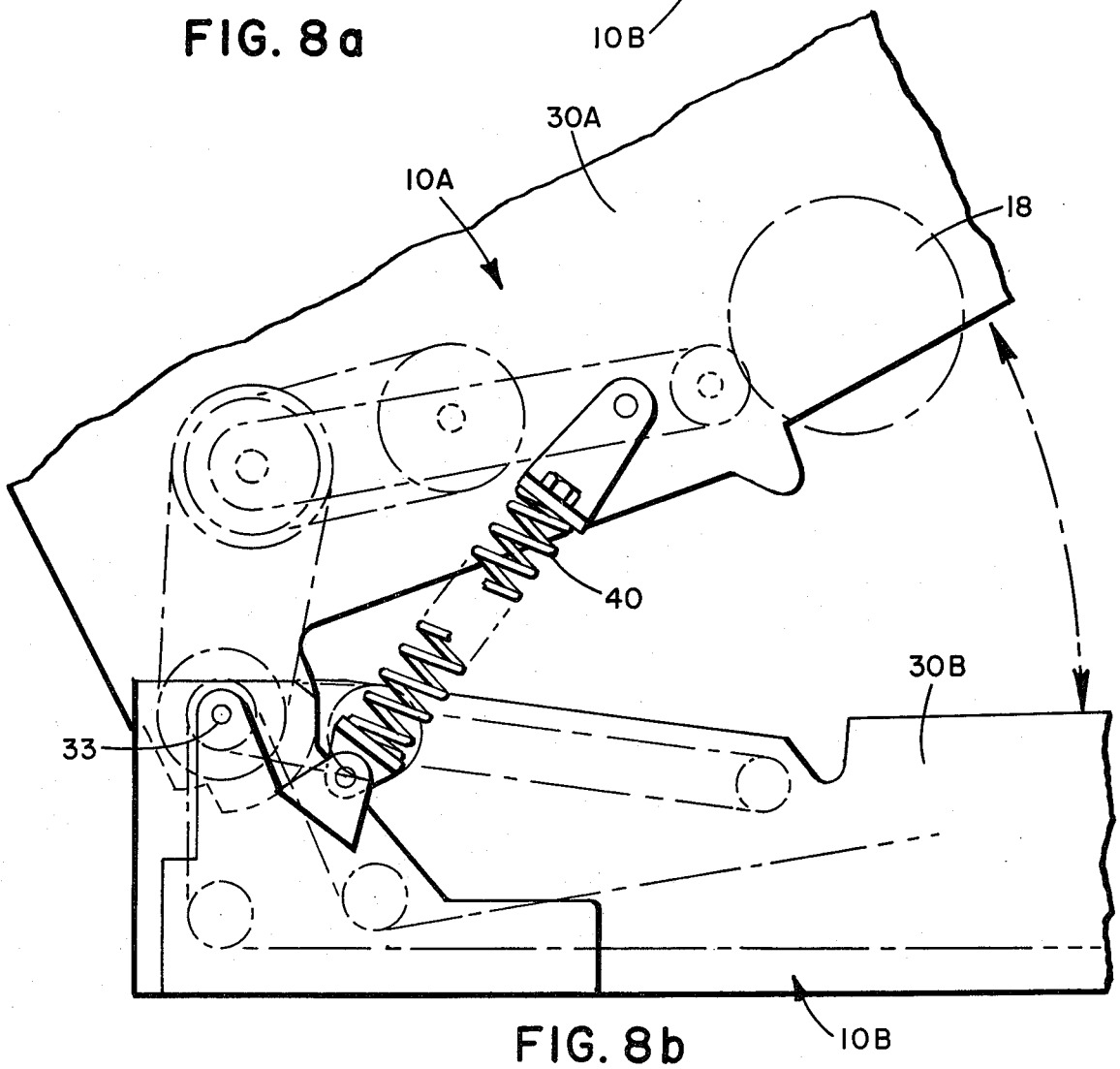

As shown in FIGS. 8(*a*) and (*b*), upper frame 30A and lower frame 30B are coupled by a lifting spring 40 which aids in raising the upper frame from the lower frame when these two frames are unlocked from each other. Spring 40 also aids in keeping upper unit 10A raised as in FIG. 3 (see FIG. 8(*b*)). Upper unit 10A is kept open permitting the operator to use both hands in removing photosensitive member 18 from subframe 35, removing jammed paper, or repairing the machine. After the operations are completed, the operator must lower the upper unit 10A to lower unit 10B. Once the dead center point of spring 40 is passed, the force of spring 40 will cause the upper unit 10A to continue rotating downward and into contact with lower unit 10B (FIG. 8(*b*)).

Figures 9, 10:
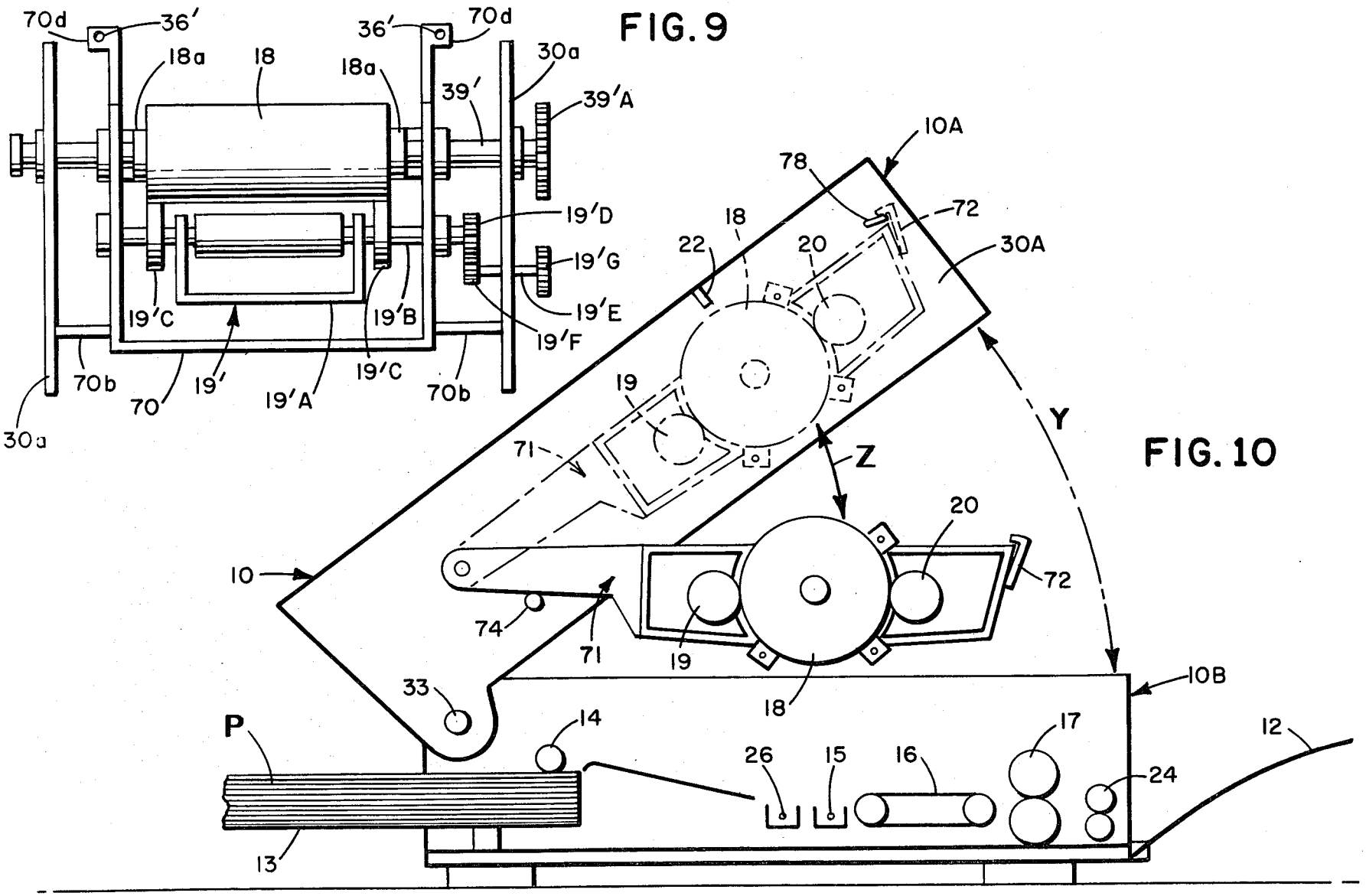
FIG. 9 is a bottom view of a subframe supporting a photosensitive member in another embodiment of this invention.
FIG. 10 is a sectional view showing a copying machine in still another embodiment of this invention.

FIG. 9 is a bottom view showing a part of a photosensitive member supporting device in another embodiment of this invention. A subframe 70 is supported rotatably at hinge pins 70*b* on the upper frame 30A. Brackets 70*d* are attached to upper frame 30A by fasteners 36'.

The relationship between subframe 70 and photosensitive member 18 in this embodiment is the same as that of the embodiment previously mentioned. When photosensitive member 18 is supported on upper frame 30A by docking shaft 39', shaft 18*a* of photosensitive member 18 is separated from subframe 70. Drawing docking shaft 39' out toward the left in FIG. 9 releases photosensitive member 18 from upper frame 30A; consequently, it drops by its own weight so that its shaft 18*a* rests in the receiving notch (not shown) of subframe 70. Therefore, photosensitive member 18 is supported on subframe 70.

In this embodiment of the invention, subframe 70 also contains the developing unit 19'. The purpose of the developing unit is to transfer electrostatically-charged toner particles onto the photosensitive member; and in performing this function, its sleeve 19'A must remain at a fixed distance from, and in alignment with, the photosensitive member. The reason for this is so that toner particles jump the air gap between the two only in response to charged areas on the photosensitive member. The fixed distance between the developing unit sleeve 19'A and photosensitive member 18 is maintained by spacing rollers 19'C. In the embodiment shown in FIG. 9, even when subframe 70 is opened for inspection of the photosensitive member 18, the proper alignment and distance can be maintained between it and the developing unit sleeve 19'A. Upon completion of the inspection and closing of subframe 70, it would therefore be unnecessary to readjust the developing unit because it would not have shifted in relation to the photosensitive member.

FIG. 10 shows the opened condition of a copying machine which is another embodiment of this invention. In this copying machine, photosensitive member 18, developing unit 19, and cleaning unit 20 are all contained in the same subframe 71 rotatably mounted on upper frame 30A. After opening upper unit 10A about hinge point 33, the operator releases a hook 72 of subframe 71 from a holding pin 78 of upper frame 30A. The subframe 71 together with photosensitive member 18, developing unit 19, and cleaning unit 20, are dropped by their own weight and rotate downward (clockwise along direction Z). The subframe 71 is stopped from further downward rotation, when it is between upper unit 10A and lower unit 10B, by stopping pin 74 of upper unit 10A. In such a construction, the relative positions among photosensitive member 18, developing unit 19, and cleaning unit 20 are accurately maintained. This results in less need for adjustment and better copies.

We claim:

1. An image-forming device comprising:

a. a casing including a lower unit and an upper unit, said upper unit being movable upward and away from said lower unit to obtain access to the interior of said casing;

b. a photosensitive member positioned in said upper unit; and c. a subframe attached to said upper unit to support said photosensitive member when said upper unit is moved upward and away from said lower unit, said subframe being movable downward from said upper unit to position said photosensitive member at an open space between said upper and lower units.

2. An image-forming device as claimed in claim 1, wherein said subframe is rotatably attached to said upper unit.

3. An image-forming device as claimed in claim 1, further comprising driving means for driving said photosensitive member, said subframe being separate from said photosensitive member when said driving means is driving said photosensitive member, and further comprising release means coupled to said driving means for releasing said photosensitive member from said driving means to position said photosensitive member on said subframe.

4. An image-forming device as claimed in claim 3, wherein said subframe includes a receiving notch in which said photosensitive member rests when it is positioned on said subframe.

5. An image-forming device as claimed in claim 1, further comprising driving means for driving said photosensitive member, said subframe supporting said photosensitive member when said driving means is driving said photosensitive member, and further comprising release means coupled to said driving means for releasing said photosensitive member from said driving means.

6. An image-forming device as claimed in claim 3 or claim 5, wherein said release means comprises a docking shaft movable along its longitudinal axis to perform said releasing function.

7. An image-forming device as claimed in claim 1, further comprising a developing unit positioned in said upper unit, said subframe supporting both said photosensitive member and said developing unit when said upper unit is moved upward and away from said lower unit.

8. An image-forming device as claimed in claim 7, further comprising a cleaning unit positioned in said upper unit and supported by said subframe when said upper unit is moved upward and away from said lower unit.

* * * * *